United States Patent [19]

Kueny

[11] 4,361,120

[45] Nov. 30, 1982

[54] ROLLER TAPPET AND METHOD OF MAKING SAME

[75] Inventor: Kenneth E. Kueny, North Muskegon, Mich.

[73] Assignee: Sealed Power Corporation, Muskegon, Mich.

[21] Appl. No.: 146,137

[22] Filed: May 2, 1980

[51] Int. Cl.[3] ..... F01L 1/14

[52] U.S. Cl. ..... 123/90.55; 123/90.5

[58] Field of Search ..... 123/90.48, 90.50, 90.55

[56] References Cited

U.S. PATENT DOCUMENTS

| | | | |
|---|---|---|---|
| 1,409,878 | 3/1922 | Mainland | 123/90.48 |
| 2,089,478 | 8/1937 | Heiss | 123/90.5 |
| 2,346,737 | 4/1944 | Essl | 123/41.01 |
| 2,385,959 | 10/1945 | Yingling | 123/90.55 |
| 3,108,580 | 10/1963 | Crane | 123/90.5 |
| 3,200,801 | 8/1965 | Dornbos | 123/90.51 |
| 3,683,876 | 8/1972 | Lesher | 123/90.55 |
| 3,795,229 | 3/1974 | Weber | 123/90.5 |
| 3,977,370 | 8/1976 | Humphreys | 123/90.5 |
| 3,998,190 | 12/1976 | Keske | 123/90.5 |
| 4,094,279 | 6/1978 | Kueny | 123/90.51 |

FOREIGN PATENT DOCUMENTS

| | | | |
|---|---|---|---|
| 2215481 | 10/1972 | Fed. Rep. of Germany . | |
| 2712765 | 11/1977 | Fed. Rep. of Germany | 123/90.5 |
| 2813132 | 9/1979 | Fed. Rep. of Germany | 123/90.55 |
| 33271 | 2/1934 | Netherlands | 123/90.48 |
| 116248 | 6/1918 | United Kingdom . | |
| 516439 | 1/1939 | United Kingdom . | |

*Primary Examiner*—Craig R. Feinberg
*Assistant Examiner*—W. R. Wolfe
*Attorney, Agent, or Firm*—Price, Heneveld, Huizenga & Cooper

[57] ABSTRACT

A roller tappet includes a body defining an elongated recess opening through the lower end thereof. A roller is rotatably mounted within the recess. The recess is dimensioned to substantially encircle and enclose said roller. The tappet body is cast from a variety of materials.

2 Claims, 6 Drawing Figures

ROLLER TAPPET AND METHOD OF MAKING SAME

BACKGROUND OF THE INVENTION

This invention relates to roller tappets for use in internal combustion engines.

Roller tappets have been employed to increase engine breathing since they allow increased lift velocity without an increase in tappet body diameter. Roller tappets are disposed within tappet bores defined by an engine block. A roller on the body is engaged directly by a cam lobe on a cam shaft. Conventional roller tappets include a central valve lifter body having a lower bifurcated end. The bifurcated end is defined by a pair of depending legs. A roller is rotatably supported on a pin extending through the depending legs. The roller tappet bore of the engine is dimensioned to provide sufficient guide surface area for proper operation of the tappet.

While conventional, non-roller type hydraulic tappets are fabricated normally from hardenable or chilled gray iron, such materials are not strong enough for use with roller tappets. The legs of the bifurcated end of the roller tappet must have sufficient strength to withstand the loads imposed on them during operation. As a result, the industry has heretofore typically specified SAE 1144 steel for the fabrication of conventional roller tappets. Such material was felt necessary to provide sufficient strength and wearability for the roller tappet to have an adequate service life. Typically, a roller tappet body is machined from bar stock. This method of manufacture necessarily requires a large capital expenditure for machining equipment necessary to provide production requirements and to maintain the necessarily exact dimensional control. An example of a roller tappet of this type may be found in commonly owned U.S. Pat. No. 3,977,370, entitled Roller Tappet and issued on Aug. 31, 1976, to Humphreys.

Roller tappets fabricated from SAE 1144 steel experience problems with wear of the guide surfaces of the tappet bores. The steel tappet bodies have a tendency to gall or chafe within the roller tappet bores which increases tolerances and results in improper tappet operation.

Commonly owned U.S. Pat. No. 4,094,279, entitled Ductile Iron Roller Tappet Body and Method for Making same and which issued on June 13, 1978, to the present inventor discloses a roller tappet which alleviates the aforementioned problems. The roller tappet disclosed therein includes a central valve lifter body fabricated from nodular iron. The tappet body provides compatability with the cast iron engine block and substantially eliminates the heretofore experienced wear and galling problems. Fabrication from ductile iron also results in significant manufacturing advantages including increased tool life, reduced chip size, increased feed rates and increased ease of machinability when compared to tappets fabricated from SAE 1144 steel. The tappet is disclosed in my aforementioned patent as preferably being machined from bar stock material.

The nature of the environment of use of roller tappets, the forces and loads imposed thereon and prior design practices clearly dictate against use of weaker steels, or other materials, such as aluminum or cast iron. The present tappet constructions would not have sufficient strength if fabricated from such materials to withstand the loads imposed upon them in operation.

SUMMARY OF THE INVENTION

In accordance with the present invention, a unique roller tappet is provided whereby the machinability problems, material selection problems and large capital expenditures for equipment are substantially eliminated or reduced. Essentially, an improved roller tappet includes an elongated body fabricated from a castable material. The body is formed with an elongated recess opening through an end thereof. A roller is rotatably supported within the recess and the recess is dimensioned to substantially enclose the roller. The body and recess configuration eliminates the bifurcated lower end or legs heretofore employed with roller tappet constructions. The enclosure of the roller significantly increases the strength of the body configuration, permitting the body to be fabricated from a wider variety of materials, such as gray iron, aluminum and the like. The body may be easily cast employing a variety of present methods, such as casting in green sand molds, shell molds, $CO_2$ molds, permanent or precision molds.

The tappet and method of forming same in accordance with the present invention eliminates the large capital expenditure for machining equipment heretofore required for the fabrication of roller tappets. A significant reduction in machining steps is experienced with a corresponding increase in ease of manufacture and a decrease in the cost of the tappet.

DETAILED DESCRIPTION OF THE PREFERRED EMBODIMENT

Figure 3:
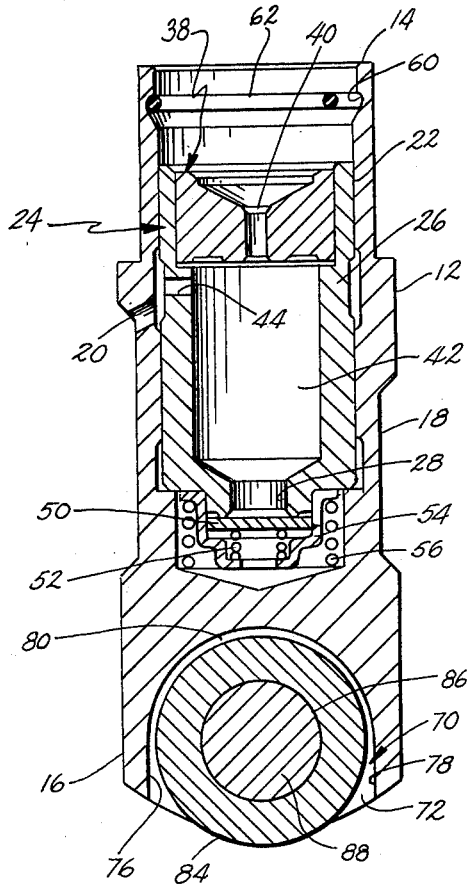
FIG. 3 is a cross-sectional view taken generally along line III—III of FIG. 2.
Figure 1:
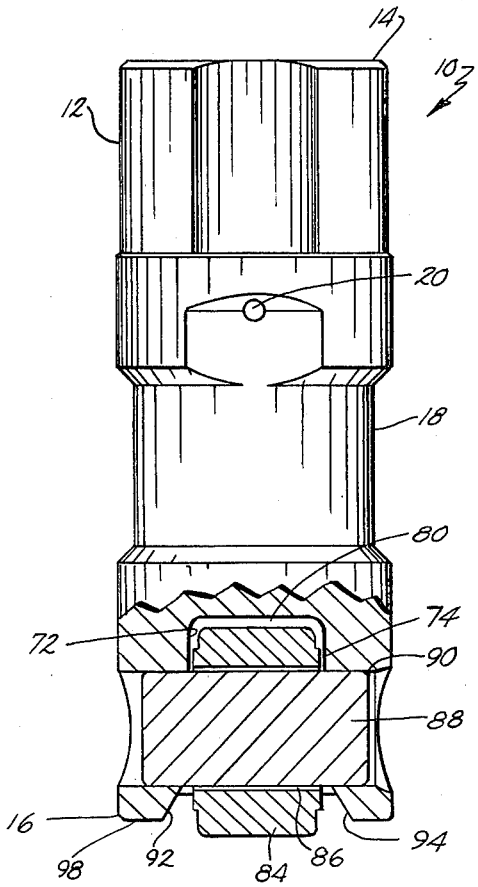
FIG. 1 is a side, elevational view in partial section of a roller tappet in accordance with the present invention.
Figure 4:
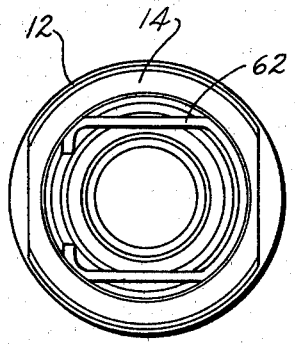
FIG. 4 is a top, plan view of the roller tappet.

A roller tappet in accordance with the preferred embodiment of the invention is illustrated in FIG. 1 and generally designated 10. Roller tappet 10 includes an elongated, generally cylindrical body 12. Body 12 includes an upper end 14 and a lower end portion 16. Body 12 defines a circumferential, annular oil receiving groove 18 and an oil inlet port or aperture 20. As best seen in FIG. 3, body 12 defines a longitudinally extending bore 22 opening through upper end 14 thereof. Slidably disposed within bore 22 is a plunger subassembly generally designated 24. Plunger subassembly 24 includes an elongated piston portion 26 having a lower valve port 28 formed therein. The upper portion of piston portion 26 is closed by a conventional push rod seat 38. Seat 38 defines a passage 40 through which oil may pass upwardly through a conventional push rod to lubricate the valve train assembly. Piston portion 26 defines an oil reservoir 42 and an inlet passage 44. Port 28 is closed by a valve member 50 biased towards the port by a spring 52. Spring 52 is held by a retainer 54. Another spring 56 engaging the lower end of bore 22 biases the plunger towards the upper end 14 of body 12. Adjacent the upper end 14 of the body is an inner, peripheral groove 60. As best seen in FIGS. 3 and 4, groove 60 receives a retainer clip 62 formed from a resilient material. Clip 62 insures that plunger subassembly 24 is retained within body 12 during handling and shipment of the roller tappet.

Figure 2:
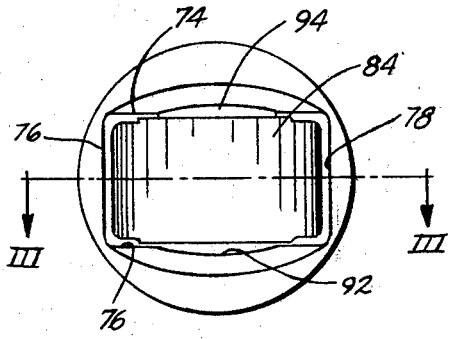
FIG. 2 is a bottom, plan view thereof.

As best seen in FIGS. 1, 2 and 3, lower end 16 of body 12 defines an elongated, longitudinally extending, enclosed recess 70 opening therethrough. Recess 70 includes opposed, spaced, generally parallel sidewalls 72, 74 joining opposed, spaced, generally parallel end walls 76, 78. As seen in FIG. 2, recess 70 is generally rectangular in transverse cross section. Sidewalls 72, 74 and end walls 76, 78 are smoothly joined to a top wall 80. As best seen in FIG. 3, top wall 80 is curvilinear in longitudinal cross section and has the shape of a half circle. Rotatably disposed within recess 70 so as to be substantially enclosed or encircled thereby is a roller 84. Roller 84 includes a central aperture 86 (FIG. 3). Extending through aperture 86 is a roller pin 88. As seen in FIG. 1, roller pin 88 also extends through and is press fit within a transverse bore 90 machined in the lower portion of body 12. As seen in FIGS. 1 and 2, sidewalls 72, 74 immediately adjacent the opening through the lower end of the body of the tappet are beveled at surfaces 92, 94. Also, as best seen in FIG. 3, the lower end 16 of tappet body 12 has a generally curved outer surface 98 through which recess 70 opens. The lower end of the body is curved to insure sufficient clearance between the body and the cam surface which engages the outer peripheral surface of roller 84.

With the tappet construction in accordance with the present invention, the roller is substantially enclosed or encircled by the tappet body and the roller operates almost totally within the body. Only a small arc of the outer periphery or the outer circumference of the roller extends from the recess formed by the body. This construction results in a significant increase in strength for the configuration when compared with prior bifurcated leg roller tappet configurations. This permits the tappet to be fabricated from less costly and lower strength materials than have heretofore been thought possible. Also, this configuration permits significant cost savings in machining and in capital expenditure for production equipment. The body 12 in accordance with the present invention may be cast and subsequently machined to the final configuration.

Figure 6:
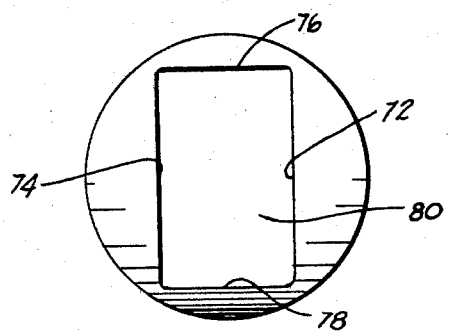
FIG. 6 is an end, elevational view of the casting.
Figure 5:
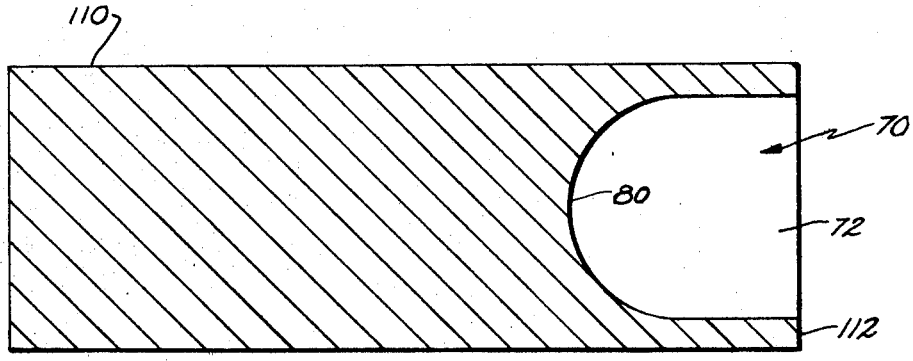
FIG. 5 is a side, cross-sectional view of a casting from which the roller tappet body is machined.

As seen in FIGS. 5 and 6, body 12 is initially formed as an elongated, generally cylindrical casting 110. Casting 110 is formed with recess 70 opening through end 112 thereof. The recess includes the opposed sidewalls 72, 74 which are generally parallel to each other and perpendicular to adjoined end walls 76, 78 and the bottom semicircular wall 80. Element 110 is readily cast using conventional methods. Tappet casting 110 may be cast from cast iron, ductile iron, steel and other metals, such as aluminum. Casting 110 can be cast in either green sand molds, shell molds, $CO_2$ molds or permanent, precision casting molds. This method of manufacture of element 110 eliminates large capital expenditures for equipment necessary to obtain production requirements and to maintain the necessary dimensional control of the part. Once element 110 is removed from the mold, machining operations may be performed on it to form the internal bore 22 of the body, oil collection groove 18, groove 60 and the like. Further, the lower end portion 112 is readily machined to form the clearance radius or surface 98 of the completed body. Precision casting molds may be used to form the grooves and other portions of the body. When using such a method, only surface finishing is necessary.

In a presently preferred embodiment of the roller tappet in accordance with the present invention, the body has an overall length of 2.6 inches and a diameter of approximately 0.92 inches. Recess 70, as cast, has a maximum transverse dimension of 0.760 inches, a maximum longitudinal length of 0.719 inches with the radius of curvature of top wall 80 being 0.38 inches. The minimum transverse dimension of the recess or width of the end walls is approximately 0.45 inches. Roller 84 has a diameter of approximately 0.70 inches.

OPERATION

In operation, roller tappet 10 in accordance with the illustrated embodiment is disposed within a tappet bore defined by the engine cylinder block. The outer peripheral surface of roller 84 rests on and is contacted by a cam lobe. The engine oiling system is placed in communication with the bore, and oil under pressure communicates through inlet ports 20, 44 to reservoir 42. A push rod engaging seat 38 is biased in contact with the rocker arm or valve train of the engine by hydraulic pressure. Oil within reservoir 42 is relieved by opening of valve 50 to enter the lower closed end of bore 22. The oil shifts or biases plunger subassembly 24 towards open end 14 of tappet body 12.

Roller tappets of the type illustrated are typically used in high performance engines or in diesel engine applications and provide increased engine breathing by allowing increased lift velocity without an increase in tappet body diameter. The roller tappet in accordance with the present invention with the enclosed and recessed roller permits a foreshortening of the roller tappet body since the roller is positioned substantially entirely within body 12. The configuration permits almost complete recessing of the roller without reduction in the external guide surfaces defined by body 12. With prior roller tappets, the bifurcated leg structure substantially exposed the roller, required higher strength materials than need be employed with a tappet in accordance with the present invention and presented difficulties with recessing or foreshortening the overall length of the tappet. These problems are eliminated by the present invention.

In view of the foregoing description, those of ordinary skill in the art will undoubtedly envision various modifications to the embodiment illustrated which would not depart from the inventive concepts disclosed herein. Therefore, it is expressly intended that the above description should be considered as that of the preferred embodiment. The true spirit and scope of the present invention may be determined by reference to the appended claims.

The embodiments of the invention in which an exclusive property or privilege is claimed are defined as follows.

1. A roller tappet adapted to be reciprocated by a cam in an internal combustion engine, said roller tappet comprising:

a cast, integral body formed from a castable, metal material having a strength less than SAE 1144 steel and which is compatible with an engine block, said body having an upper end and a lower end facing the cam, said body defining an oil inlet, a central bore opening through said upper end, and an enclosed recess opening through the lower end, said enclosed recess including spaced, generally parallel sidewalls, spaced, generally parallel end walls joined to said sidewalls and a generally semi-circular top wall joined to said sidewalls and said end walls, said sidewalls and end walls defining a curved outer surface at said lower end through which said enclosed recess opens;

a plunger reciprocal within said central bore of said body, said plunger defining an oil reservoir in communication with said oil inlet;

a roller having an outer peripheral surface and a radius of curvature; and means engaging said body for rotatably supporting said roller within said enclosed recess, said roller and said enclosed recess dimensioned to substantially enclose and encircle said roller with only a small portion of the outer peripheral surface of said roller extending from said enclosed recess, said outer surface of said lower end having a radius of curvature greater than and closely following that of the radius of curvature of said roller to define a clearance recess which insures clearance between the body and the cam which engages the outer peripheral surface of said roller, said means for rotatably supporting said roller comprising a pin extending through said roller and into said sidewalls of said recess.

2. A roller tappet body adapted to rotatably support a roller and to be reciprocated by a cam engaging the roller, the roller having a radius of curvature, said body comprising:

an elongated, integral, cast and machined member formed from a castable, iron material having a strength less than SAE 1144 steel which is compatible with an engine block, said member defining an elongated bore for receiving a push rod seat and an enclosed recess opening through a lower end of said member opposite said bore and adapted to face the cam, said enclosed recess including spaced sidewalls joined by spaced end walls and a curved top wall joined to said sidewalls and said end walls, said enclosed recess dimensioned to substantially encircle and enclose a roller, said sidewalls being substantially perpendicular to said end walls, said enclosed recess being generally rectangular in transverse cross section, said top wall being semicircular in longitudinal cross section and the lower end of said body having an outer surface which is smoothly curved, said outer surface having a substantially constant radius of curvature greater than and closely following that of the radius of curvature of the roller to define a clearance recess, thereby permitting said cast body to still have sufficient strength to support a roller which is substantially enclosed within said recess, said body further defining a transverse bore extending through said sidewalls which is dimensioned to receive a roller support pin, said transverse bore positioned so that when the roller is in said enclosed recess, only a small portion of an outer periphery of the roller extends from said enclosed recess.

* * * * *